US008292614B2

(12) United States Patent
Mitchell

(10) Patent No.: US 8,292,614 B2
(45) Date of Patent: Oct. 23, 2012

(54) LIQUID FUEL CELL

(75) Inventor: Charles R. K. Mitchell, Manlius, NY (US)

(73) Assignee: Hollowick, Inc., Manlius, NY (US)

( * ) Notice: Subject to any disclaimer, the term of this patent is extended or adjusted under 35 U.S.C. 154(b) by 623 days.

(21) Appl. No.: 12/479,401

(22) Filed: Jun. 5, 2009

(65) Prior Publication Data

US 2009/0239186 A1 Sep. 24, 2009

Related U.S. Application Data

(63) Continuation-in-part of application No. 11/230,054, filed on Sep. 19, 2005, now abandoned.

(51) Int. Cl.
*F23D 3/28* (2006.01)

(52) U.S. Cl. ..... 431/120; 431/315; 431/325; 126/45; 126/46; D26/116

(58) Field of Classification Search ..... 431/120, 431/315, 325; D26/116; 126/45, 46
See application file for complete search history.

(56) References Cited

U.S. PATENT DOCUMENTS

| | | | | | |
|---|---|---|---|---|---|
| 1,002,279 | A | * | 9/1911 | Karvakko | 431/120 |
| 1,864,489 | A | * | 6/1932 | Gennrich | 431/120 |
| 2,784,581 | A | * | 3/1957 | Quandt | 431/301 |
| 3,180,118 | A | * | 4/1965 | Brender | 431/273 |
| 3,994,672 | A | | 11/1976 | Novak | |
| 4,025,290 | A | * | 5/1977 | Giangiulio | 431/324 |
| 4,126,408 | A | * | 11/1978 | Cox | 431/2 |
| 4,496,307 | A | * | 1/1985 | Ginardi | 431/34 |
| 4,526,530 | A | * | 7/1985 | Menter et al. | 431/34 |
| 4,611,986 | A | * | 9/1986 | Menter et al. | 431/320 |
| 4,624,633 | A | | 11/1986 | Bandel | |
| 4,874,924 | A | * | 10/1989 | Yamamoto et al. | 392/395 |
| 5,000,678 | A | * | 3/1991 | Thompson | 431/320 |
| 5,127,825 | A | * | 7/1992 | Tendick, Sr. | 431/320 |
| 5,127,922 | A | * | 7/1992 | Bension | 44/275 |
| 5,211,553 | A | * | 5/1993 | Menter | 431/320 |
| 5,529,485 | A | | 6/1996 | D'Amero et al. | |
| 5,785,513 | A | * | 7/1998 | Kiefer et al. | 431/320 |
| 5,829,966 | A | * | 11/1998 | Stoner | 431/320 |
| 5,847,492 | A | * | 12/1998 | Frantello | 313/141 |
| 6,537,063 | B1 | * | 3/2003 | Pecoskie | 431/324 |
| 6,733,281 | B1 | * | 5/2004 | Stoner | 431/323 |
| 2003/0036337 | A1 | * | 2/2003 | Lemieux | 451/38 |
| 2003/0039936 | A1 | | 2/2003 | Hoffmann | |
| 2004/0166452 | A1 | * | 8/2004 | McInnis | 431/120 |

OTHER PUBLICATIONS

International Search Report/Written Opinion for PCT/US2010/037404 (ISR/WO); mailed Jan. 7, 2011; 8 pages.

* cited by examiner

*Primary Examiner* — Kenneth Rinehart
*Assistant Examiner* — Jorge Pereiro
(74) *Attorney, Agent, or Firm* — Hiscock & Barclay, LLP

(57) ABSTRACT

A liquid fuel cell that includes a canister having a fuel reservoir and a burner assembly mounted upon the canister. The burner assembly contains a wick holding aperture that opens into the fuel reservoir and a wick that is made up of continuous fiber strands mounted in the tube. The wick is doubled over to create a crown that is vertically disposed above the top of the wick holding aperture and the two ends of the wick are arranged to pass down through the wick burner into the fuel reservoir. A number of fiber strands are severed in the crown region to create a small island of bristles which greatly enhances the wick's ability to be rapidly and efficiently ignited.

15 Claims, 2 Drawing Sheets

LIQUID FUEL CELL

CROSS REFERENCE TO RELATED PATENT APPLICATIONS

This non-provisional utility patent application is a child and a continuation-in-part (CIP) application under 37 CFR 1.53(b) of a parent non-provisional patent application having a Ser. No. 11/230,054 that was filed on Sep. 19, 2005 and titled "Liquid Fuel Cell". This application further claims priority to and incorporates by reference the parent application (Ser. No. 11/230,054) in its entirety.

FIELD OF THE INVENTION

This invention relates to a liquid fuel cell and, in particular, to a liquid fuel cell that provides for more rapid and efficient lighting of the burner wick.

BACKGROUND OF THE INVENTION

Liquid fuel cells which contain a wick-type burner are widely used in restaurants, banquet halls, and the like to provide intimate table lighting for the customers or attendees and for heating or warming food. Many of these fuel cells presently utilize fuels that have a relatively low flash point and are thus highly volatile or become excessively volatile when heated, and can create a fire hazard. In addition, many of the low flash point fuels give off noxious vapors when burned which may be unpleasant when many fuel cells are burning at the same time within an enclosed hall or dining area.

As disclosed in U.S. Pat. No. 4,624,633 to Bandel, fuels have been developed for use in liquid fuel cells that overcome many of the disadvantages associated with the low flash point fuels. The newer fuels also provide extended burning times when compared to more volatile fuels. As a result, the newer fuels have found wide use in smaller size fuel cells that are typically utilized used for heating or warming food or providing intimate table lighting.

The time required to ignite the burner wick of a fuel cell containing a high flash point fuel, however, is considerably longer than that needed to light a fuel cell containing a fuel having a lower flash point. Although the difference in ignition time might be measured in seconds, the total time needed to light all the table lamps in a fair sized restaurant or hall can be considerable. The chance of producing a mislight is also greater due to the longer ignition time.

SUMMARY OF THE INVENTION

It is therefore a primary object of the invention to improve liquid fuel cells of the type used for table lighting.

It is a further object of the present invention to improve liquid fuel cells containing a fuel having a high flash point.

It is a still further object of the present invention to shorten the ignition time of a liquid fuel cell that contains a fuel having a high flash point.

Another object of the present invention is to improve the safety of fuel cells by allowing for the convenient use of higher flash point fuels.

These and other objects of the present invention are attained by a liquid fuel cell that includes a canister having a reservoir for holding a quantity of liquid fuel. A burner is mounted upon the canister which contains a vertically disposed wick holding aperture that opens into the fuel reservoir. A wick is mounted in the wick tube which is formed of continuous strands of a wicking material, also referred to as wick fiber strands, wick strands or fiber strands. The wick is doubled over to create a U-shaped crown in its mid-region with the ends of the wick passing down through the wick holding aperture into the reservoirs whereby fuel is drawn into the crown region by capillary action. A number of strands in the crown region are severed to create a small island made up of a series of short bristles at each discontinuation point which provide for a more rapid and efficient ignition of the burner wick.

BRIEF DESCRIPTION OF THE DRAWINGS

For a better understanding of these and other objects of the present invention, reference will be made to the following detailed description of the invention which is to be read in association with the accompanying drawings, wherein.

DETAILED DESCRIPTION OF THE INVENTION

Figure 1:
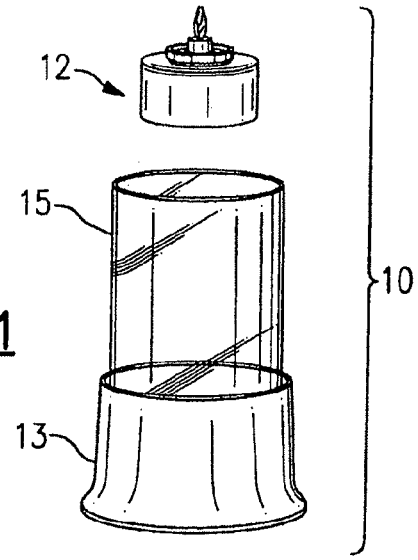
FIG. 1 is an exploded view in perspective illustrating a table lamp embodying the teachings of the present invention.

Referring initially to FIG. 1, there is illustrated a lamp, generally referenced 10, for providing intimate lighting for a table or the like. The lamp assembly in this embodiment is a relatively small unit for producing intimate table lighting which now enjoys wide popularity in restaurants, banquet halls, and the like. The lamp is equipped with a disposable liquid fuel cell 12 that is removably fitted into a seat (not shown) located in the base 13 of the lamp. Although the present invention will be described with specific reference to a disposable fuel cell providing intimate table lighting, it should be obvious to one skilled in the art that the invention can be utilized in both disposable and reusable fuel cells that employ a wick type burner that can be used for other purposes such as chafing dish applications. The lamp itself may take any form that is aesthetically pleasing, as well as being able to function for its intended purpose. In this embodiment, the lamp includes a transparent, removable chimney or globe 15 having an open top which is securely fitted to the base.

Because most lamps used for intimate table lighting are relatively small in size, the fuel cell that can be accommodated within the base must be correspondingly small. As a consequence, the amount of fuel that can be stored within the reservoir of this cell is limited. As noted above, fuels having a high flash point above 200 degrees Fahrenheit (F.) have been developed for use in liquid fuel cells for safety reasons. In addition, fuels having a high flash point provide a longer burning time than those having a lower flash point, and are thus better suited for use in smaller fuel cells of the type utilized in lamps for intimate table lighting. The high flash point fuels, however, present certain challenges relative to the lower flash point fuels, one of which being an increased time to light the wick of the burner.

Figure 2:
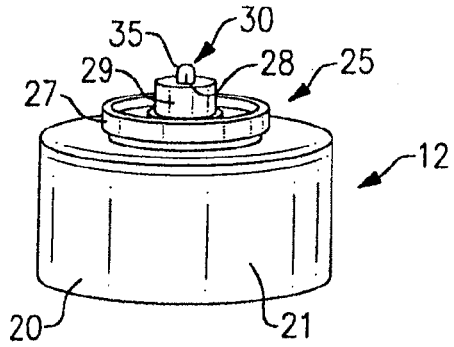
FIG. 2 is an enlarged perspective view showing a liquid fuel cell suitable for use in the table lamp shown in FIG. 1.
Figure 3:
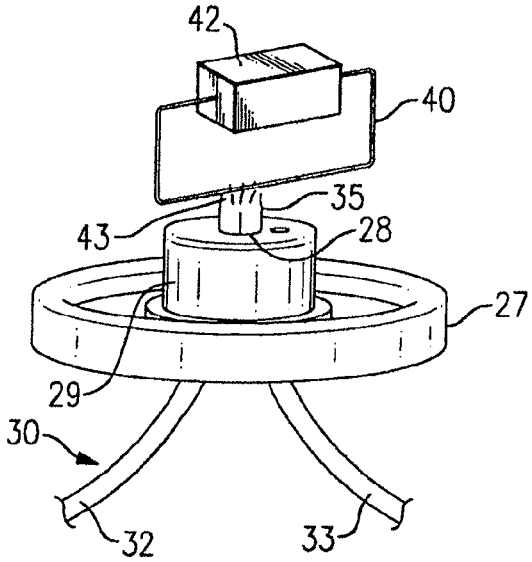
FIG. 3 is a further enlarged perspective view showing the wick in the burner section of the fuel cell being treated to produce bristle-like discontinuations in the wick fibers.
Figure 4:
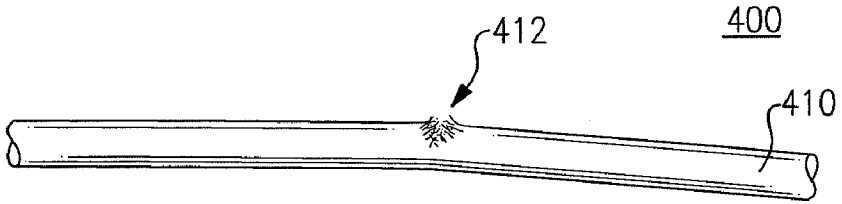
FIG. 4 shows a wick 410 (not necessarily to scale) that is manufactured to include strands that are severed at a location 412 between two terminal ends of the wick.
Figure 5:
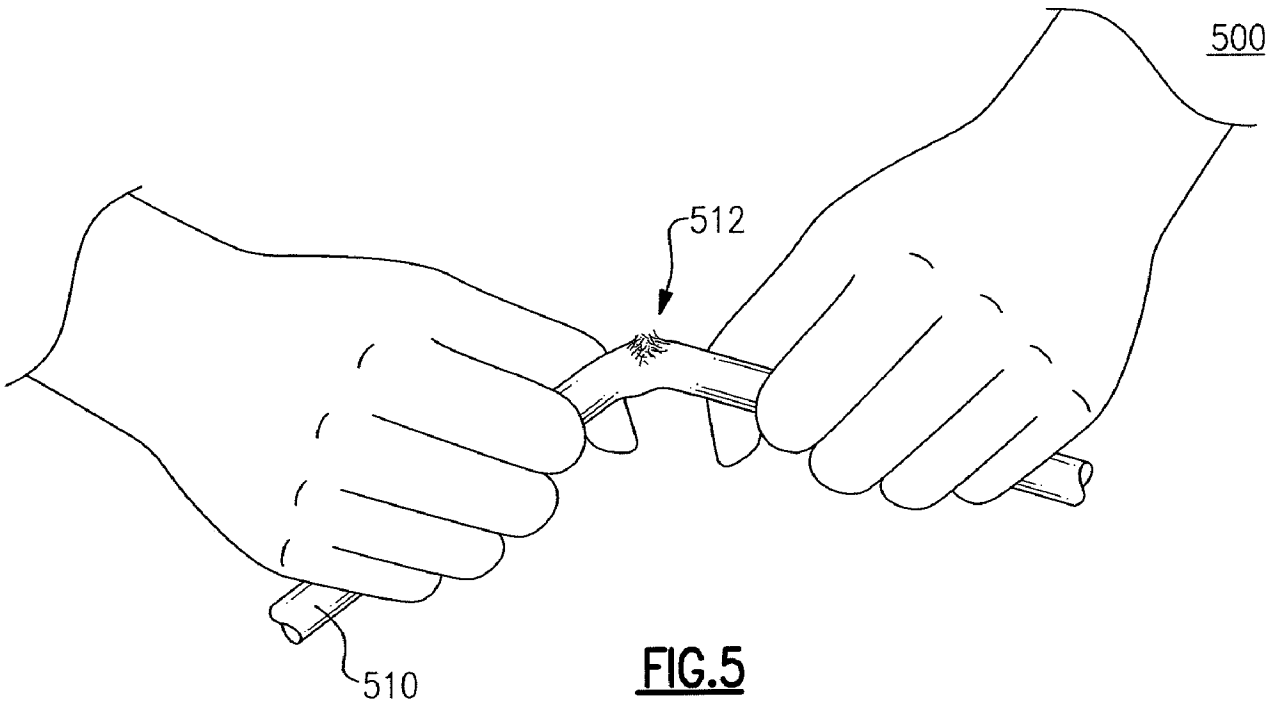
FIG. 5 shows a wick 510 (not necessarily to scale) that is designed to include strands that are severed at a location 512 between two terminal ends of the wick as a result of employing a tensile or torsional force to the location.

With further reference to FIGS. 2 and 3, the fuel cell 12 includes a canister 20 having a reservoir 21, which in the case of a tealight is capable of holding a limited amount of fuel. The canister is made of a transparent material so that the user will have a clear visual indication of the amount of fuel that remains in the cell. The canister is closed by a top mounted burner assembly that is generally referenced 25. The assembly includes a cap 27 that closes the top opening in the canister and a vertically disposed wick holding aperture 28 that is located in the center of the cap. The aperture may be a simple hole that is passed through the top cover of the cell or contained in a tube 29 mounted in the cover. The wick holding aperture opens into the fuel reservoir of the fuel cell.

A wick 30 is mounted in the wick holding aperture 28. The wick is fabricated from a number of continuous fiber strands that extend from one end 32 of the wick to the other end 33. In assembly, the wick is doubled over in its mid-region to create a crown 35 and the crown is drawn or otherwise passed upwardly through the wick holding aperture so that it extends some distance above the top of the burner. The two ends of the wick pass downwardly through the aperture into the fuel reservoir and typically are seated along the bottom wall of the reservoir so that both ends of the wick are well inundated within the fuel contained within the reservoir.

The wick may be fabricated of any one of many well-known wicking materials that are capable of drawing fuel from the reservoir into the wick crown region via capillary action. The crown of the wick is typically lighted by placing a flame in close proximity to the crown to heat the fuel to or beyond its flash point. In the case of a wick having unbroken strands, the time required to produce ignition is generally relatively long when compared to the ignition time associated with fuels having lower flash points, the ignition time generally being in the five to six second range in the case of fuels that have a flash point at or above 300.degree. F.

Applicant, through experimentation, has found that the ignition time of a fuel cell of the type herein described can be considerably shortened by producing a discontinuation (severance) in a small group of fiber strands within the crown region. Suitable discontinuation (severance) of the wick strands can be produced by touching the crown surface with a wire 40 that is heated to a desired temperature by connecting the wire to a suitable source of electric power 42. The heated wire remains in contact with the wick until such time as a small island of short bristles 43 is created in the wire contact region whereupon the heated wire is removed from contact from the surface of the crown.

Although a heated wire has been found to work well in practice, the wick strand fiber bristles may also be created using at least one of a variety of strand severing methods and/or instruments, which include but are not limited to use of a sharp blade, a laser beam, a water knife, a cutting instrument, an abrading instrument, a heating or burning instrument, a dissolving chemical or any other instrument and/or method that is capable of severing at least one or more of the strands that are located in the crown region of the wick. An abrading instrument and/or method uses friction, such as that resulting from rubbing, grinding and/or scraping to sever material including such as a wick strand. An abrasion instrument is anything that can apply friction for rubbing, grinding or scraping in order to sever the wick strands. For example, an instrument that includes such as a rigid and/or sharp edge like that of a knife blade or that includes a rigid and textured surface, such as that of a file for grinding a surface, can be employed as an embodiment of an abrasion instrument.

In other embodiments, a wick can be manufactured to include one or more strands that are "pre-severed" at a location suitable for placement of the U shaped crown, such as an approximate middle location between two terminal ends of the wick. Or alternatively, a wick can be manufactured to include one or more strands that are made to be fragile, such as being vulnerable to tearing or breaking at a middle location between two terminal ends of the wick. This type of embodiment is analogous to that of perforated paper that is pre-manufactured to be severed (torn) at a particular location or along a path of the plane of the perforated. Application of a tensile or torsional force to the fragile middle location of the wick would sever (tear or break) one or more strands of the wick.

While the present invention has been described with specific reference to a fuel cell for use in a small lamp for providing intimate table lighting, it should be obvious to one skilled in the art that the invention has a broader application for use in any type of fuel cell that employs a fuel having a relatively high flash point.

The invention claimed is:

1. A liquid fuel cell that includes:

a canister having a fuel reservoir for holding a quantity of liquid fuel;

a burner mounted upon said canister, said burner having a wick holding aperture that opens into said fuel reservoir;

a wick including continuous strands of wicking material that extend from one end of said wick to another end of said wick, said wick passing through said wick holding aperture, said wick being doubled over to form a U-shaped crown, said wick extending from said U-shaped crown of said wick that is located above said wick holding aperture, and passing downwardly through said wick holding aperture and extending into said fuel reservoir, whereby said liquid fuel is supplied to said U-shaped crown of said wick via capillary action; and wherein a fraction representing substantially less than all-of said continuous strands that are located within said U-shaped crown of said wick are severed in a manner to create a region of bristles at said U-shaped crown and without entirely severing said wick at said U-shaped crown, in order to enhance rapid and efficient lighting of said wick at said U-shaped crown.

2. The fuel cell of claim 1, wherein said fuel has a high flash point of above 200 degrees F.

3. The fuel cell of claim 2, wherein the flash point of said fuel is above 300 degrees F.

4. The fuel cell of claim 1, wherein the flash point of said fuel is about 200 degrees F.

5. The fuel cell of claim 1 wherein said wick is manufactured to include one or more strands that are severed at a location between two terminal ends of said wick.

6. A method of shortening the ignition time of a liquid fuel cell having a burner and a fuel reservoir for holding a quantity of liquid fuel, said method including the steps of:

providing a wick including continuous strands of wicking material that extend from one end of said wick to another end of said wick;

doubling over said wick to establish a U-shaped crown within a mid-region of said wick;

mounting said wick within a wick holding aperture in a burner in a manner so that said U-shaped crown of said wick is located above said wick holding aperture and said one end and said another end of said wick pass downwardly through said wick holding aperture and extend into said fuel reservoir; whereby said liquid fuel is supplied to said U-shaped crown of said wick via capillary action; and modifying said wick by severing a fraction representing substantially less than all of said continuous strands within said U-shaped crown in a manner to create a plurality of bristles within said U-shaped crown while not entirely severing said wick at said U-shaped crown, in order to enhance rapid and efficient lighting of said wick at said U-shaped crown.

7. The method of claim 6, wherein said bristles are created by touching a plurality of strands at said U-shaped crown of said wick with a heated wire.

8. The method of claim 6, wherein said bristles are created by severing a plurality of adjacent strands at said U-shaped crown by employing a severing instrument.

9. The method of claim 8, wherein said severing instrument is a cutting instrument.

10. The method of claim 8 wherein said severing instrument is an abrading instrument.

11. The method of claim 8 wherein said severing instrument is a heating instrument.

12. The method of claim 6 that includes a further step of filling said fuel reservoir with a quantity of liquid fuel that has a high flash point of above 200 degrees F.

13. The method of claim 12, wherein said fuel reservoir is filled with a fuel having a flash point about 200 degrees F.

14. The method of claim 12, wherein said fuel reservoir is filled with a fuel having a flash point above 300 degrees F.

15. The method of claim 6 wherein said wick is manufactured to include one or more strands that are designed to be severed at a location between two terminal ends of said wick by employing a tensile or torsional force to said location.

* * * * *